US010989051B2

(12) United States Patent
Xie et al.

(10) Patent No.: US 10,989,051 B2
(45) Date of Patent: Apr. 27, 2021

(54) MULTI-SECTION NON-PILLAR STAGGERED PROTECTED ROADWAY FOR DEEP INCLINED THICK COAL SEAM AND METHOD FOR COAL PILLAR FILLING BETWEEN SECTIONS

(71) Applicant: XI'AN UNIVERSITY OF SCIENCE AND TECHNOLOGY, Xi'an (CN)

(72) Inventors: Panshi Xie, Xi'an (CN); Yingyi Zhang, Xi'an (CN); Yanli Zhang, Xi'an (CN); Shuangqi Tian, Xi'an (CN); Jianjie Duan, Xi'an (CN)

( * ) Notice: Subject to any disclaimer, the term of this patent is extended or adjusted under 35 U.S.C. 154(b) by 0 days.

(21) Appl. No.: 16/740,757

(22) Filed: Jan. 13, 2020

(65) Prior Publication Data

US 2020/0232323 A1 Jul. 23, 2020

(30) Foreign Application Priority Data

Jan. 21, 2019 (CN) ..... 201910054223.9

(51) Int. Cl.

| | |
|---|---|
| ***E21C 41/18*** | (2006.01) |
| *E21D 23/00* | (2006.01) |
| *E21C 27/02* | (2006.01) |

(52) U.S. Cl.

CPC ..... *E21C 41/18* (2013.01); *E21C 27/02* (2013.01); *E21D 23/0004* (2013.01); *E21D 23/0082* (2013.01)

(58) Field of Classification Search

CPC ..... E21C 41/18

See application file for complete search history.

(56) References Cited

U.S. PATENT DOCUMENTS 4,030,752 A * 6/1977 Simpson ..... E21C 41/18 299/11

4,391,469 A * 7/1983 Arsuaga ..... E21D 23/0082 299/11

FOREIGN PATENT DOCUMENTS

| | | | | |
|---|---|---|---|---|
| AU | 2020100380 | * | 4/2020 | |
| GB | 890329 A | * | 2/1962 | ..... E21C 41/16 |
| SU | 1479646 | * | 5/1989 | |

* cited by examiner

*Primary Examiner* — Janine M Kreck

(74) *Attorney, Agent, or Firm* — Egbert Law Offices, PLLC

(57) ABSTRACT

Disclosed is a multi-section non-pillar staggered protected roadway for a deep inclined thick coal seam (DITCS) and a method for coal pillar filling between sections. The multi-section non-pillar staggered protected roadway includes a floor, a coal seam, an immediate roof, and a basic roof in a multi-section coal seam, where the floor is disposed below the coal seam, a hydraulic support is disposed in a section between the floor and the immediate roof; a return airway and a transportation roadway are respectively disposed on a left side and a right side of each section; the return airway and the transportation roadway in each section are communicated with each other through a working face; and non-pillar staggered layout is used for a return airway of a next section and a transportation roadway of a current section.

18 Claims, 3 Drawing Sheets

MULTI-SECTION NON-PILLAR STAGGERED PROTECTED ROADWAY FOR DEEP INCLINED THICK COAL SEAM AND METHOD FOR COAL PILLAR FILLING BETWEEN SECTIONS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a roadway layout and filling method of an underground coal mining working face, and in particular, to a multi-section non-pillar staggered protected roadway for deep inclined thick coal seams (DITCS) and a method for coal pillar filling between sections.

2. Description of Related Art Including Information Disclosed Under 37 CFR 1.97 and 37 CFR 1.98

A deep inclined coal seam is a buried coal seam with an inclination between 35° and 55°. Deep inclined coal seams, especially DITCSs, can be found in major mining areas in Xinjiang, Sichuan, Gansu, Ningxia, and Guizhou in China. In some mining areas (for example, mining areas in Xinjiang and Ningxia), DITCSs account for 60% of the total deep inclined coal seams. Existing fully mechanized longwall mining technologies of deep inclined coal seams are gradually maturing. However, in a multi-section mining process of a deep inclined coal seam, a mechanism of action of an inclined upper-section stope on an inclined lower-section stope is obviously different from that of near-horizontal coal seam mining. Surrounding rock transportation and a stress superposition effect in a multi-section stope not only seriously affect the stability of a coal pillar section and a mining roadway, but also change a load characteristic of a roof of the lower-section stope. Especially during mining of a deep inclined thick coal seam, a coal pillar section has a larger space size, and its deformation, destruction, and transportation characteristics are more complex, which seriously affects the stability of a mining roadway and surrounding rock of a lower-section stope. Therefore, a feasible method is urgently needed to effectively alleviate or resolve a problem of interaction between sections.

BRIEF SUMMARY OF THE INVENTION

An objective of the present invention is to provide a non-pillar staggered excavated roadway-protected roadway for a longwall working face of a deep inclined thick coal seam (DITCS) and a method for natural filling of caving gangue in a goaf. The present invention has an appropriate design, and can effectively alleviate a problem of deformation and destruction of a roadway and a coal pillar between sections due to stress superposition in a stope. In addition, the present invention can implement non-pillar mining or small-pillar mining of a thick coal seam of a deep inclined longwall working face. This increases a recovery rate of coal resources between an upper section and a lower section, improves the unbalanced load on a stope roof of the lower section, and ensures safe mining of a working face of the lower section, thereby resolving a problem existing in the prior art.

The present invention is implemented by using the following technical solutions:

A multi-section non-pillar staggered protected roadway for a DITCS is provided, including a floor, a coal seam, an immediate roof, and a basic roof in a multi-section coal seam, where the floor is disposed below the coal seam, a hydraulic support is disposed in a section between the floor and the immediate roof; a return airway and a transportation roadway are respectively disposed on a left side and a right side of each section; the return airway and the transportation roadway in each section are communicated with each other through a working face; and non-pillar staggered layout is used for a return airway of a next section and a transportation roadway of a current section.

Based on the foregoing technical solution, the present invention further provides a further preferred solution:

Further, the non-pillar staggered layout should meet a requirement of a thickness of a coal seam between the return airway of the next section and the transportation roadway of the current section, that is, a vertical distance between the roadways is greater than 2 m.

Further, when a thickness of a coal seam section is 3.5-4.0 m, lower staggered layout is used for the return airway of the next section and the transportation roadway of the current section, that is, the return airway of the next section is located on a lower right side of the transportation roadway of the current section.

Further, when a thickness of a coal seam section is 4.0-5.5 m, superposed layout is used for the return airway of the next section and the transportation roadway of the current section, that is, the return airway of the next section is located right below the transportation roadway of the current section.

Further, when a thickness of a coal seam section is greater than 5.5 m, upper staggered layout is used for the return airway of the next section and the transportation roadway of the current section, that is, the return airway of the next section is located on a lower left side of the transportation roadway of the current section.

Further, a flexible bolt-mesh-anchor support manner is used for the return airway in each section.

The present invention provides a method for coal pillar filling between sections of the multi-section non-pillar staggered protected roadway for a DITCS, where the method includes the following steps:

(1) during longwall mining of a DITCS, after a first-section working face is mined, mining out coal on a side obliquely below a second-section return airway along with mining of a second-section working face, successively withdrawing hydraulic supports and placing them onto a working face of a next section, forming crushed coal when fractured coal of a first section on a side obliquely above the roadway is immediately destructed because the roadway becomes instable, and transporting the crushed coal to above a second-section goaf;

(2) allowing caving gangue in a first-section goaf to move towards the second-section goaf along the passage, filling the caving gangue and the crushed coal together obliquely above the second-section goaf, so that an inclined upper part, middle part, and lower part of the second-section goaf are all filled with a destroyed rock strata; and (3) conducting roadway layout, mining, and filling of working faces of a third section, a fourth section, . . . , an Nth section by using a same method as that used for the second section.

Further, a flexible bolt-mesh-anchor support manner is used for all mining roadways, to ensure that gangue in an upper-section goaf can be effectively transported to a lower-section goaf in time.

According to the technical solutions of the present invention, the present invention has the following beneficial effects:

The present invention proposes a non-pillar staggered excavated roadway-protected roadway for a longwall working face of a DITCS and a method for natural filling of caving gangue in a goaf. The present invention has an appropriate design, and can effectively alleviate a problem of deformation and destruction of a roadway and a coal pillar between sections resulting from stress superposition in a stope. In addition, the present invention can implement non-pillar mining or small-pillar mining of a thick coal seam of a deep inclined longwall working face. This increases a recovery rate of coal resources between an upper section and a lower section, improves the unbalanced load on a stope roof of the lower section, and ensures safe mining of a working face of the lower section.

BRIEF DESCRIPTION OF THE SEVERAL VIEWS OF THE DRAWINGS

The accompanying drawings described herein are provided for further understanding of the present invention, constitute a part of this application, but do not constitute an improper limitation on the present invention. In the accompanying drawings:

FIG. 1(*b*) is a layout diagram of a second-section roadway during mining of a first-section working face;

FIG. 1(*c*) is a characteristic pattern of second-section mining and transportation and filling of gangue in a goaf; FIG. 2(*a*) shows an upper staggered layout form; FIG. 2(*b*) shows a superimposed layout form; and FIG. 2(*c*) shows a lower staggered layout form.

In the figures, 1—floor; 2—coal seam; 3—immediate roof; 4—basic roof; 5—first-section return airway; 6—first-section transportation roadway; 7—second-section return airway; 8—second-section transportation roadway; 9—first-section working face; 10—second section; 11—hydraulic support; 12—first-section goaf; 13—second-section working face; 14—fractured coal; 15—third-section return airway; 16—second-section goaf; and 17—crushed coal.

DETAILED DESCRIPTION OF THE INVENTION

The present invention is described in detail below with reference to the accompanying drawings and specific embodiments. Exemplary embodiments and description of the present invention are intended to explain the present invention herein, but are not intended to limit the present invention.

Figure 1A:
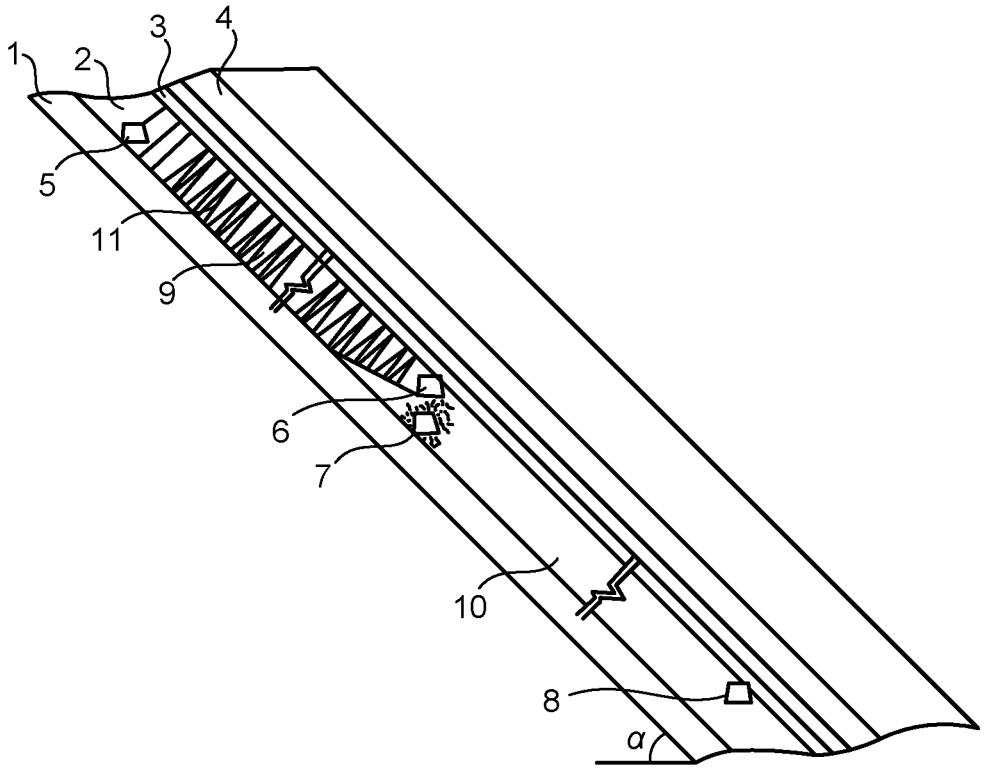
FIG. 1(*a*) is a layout diagram of a multi-section roadway and a working face.
Figure 1B:
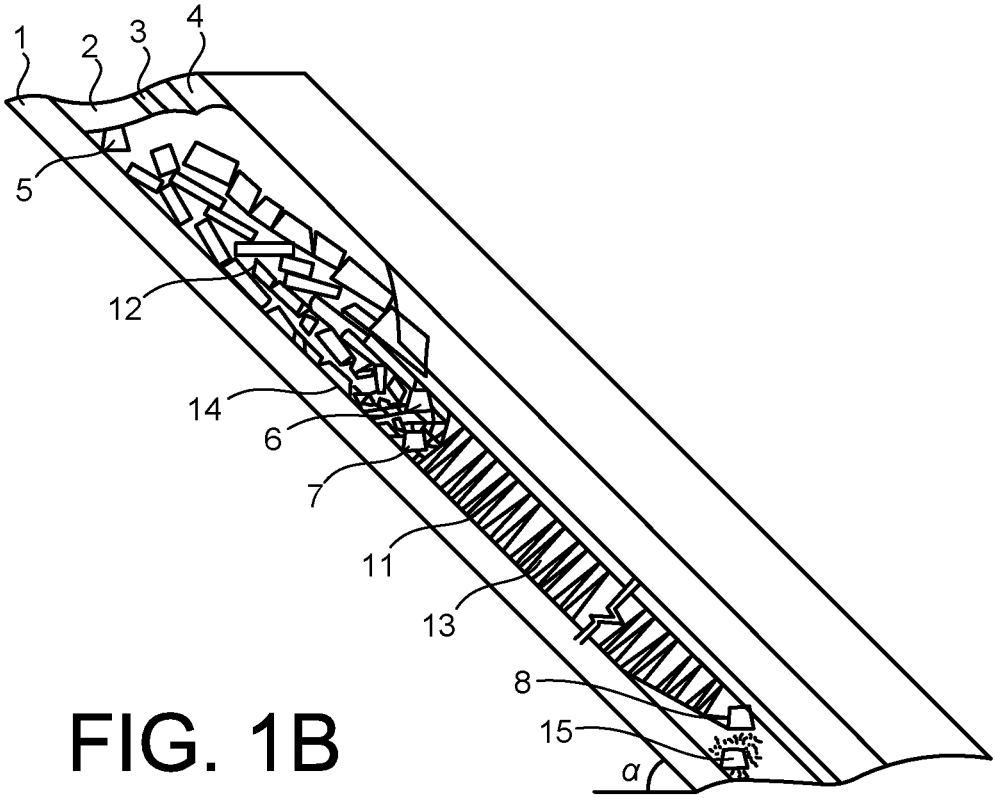
Figure 1C:
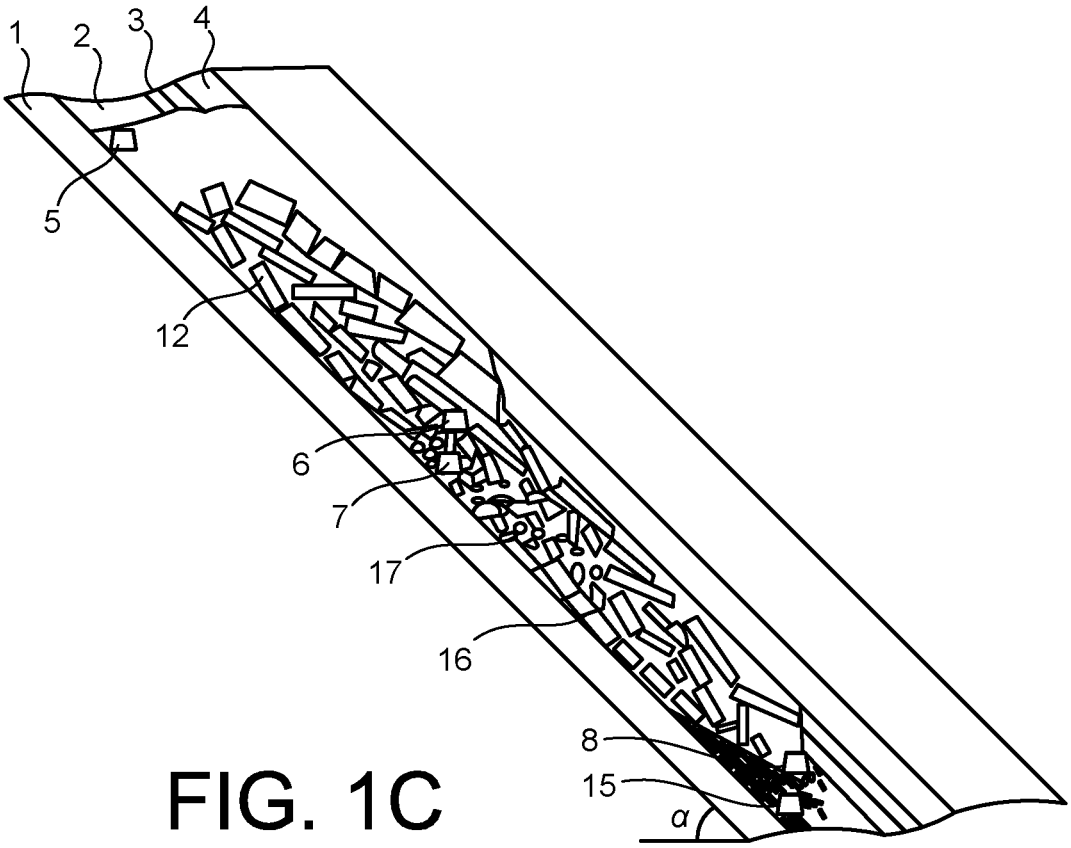

For an overall structure of the present invention, refer to FIG. 1(*a*) and FIG. 1(*b*). The present invention proposes a multi-section non-pillar staggered protected roadway for a DITCS. The multi-section non-pillar staggered protected roadway includes a floor 1, a coal seam 2, an immediate roof 3, and a basic roof 4 in a multi-section coal seam 2. The floor 1 is disposed below the coal seam 2, a hydraulic support 11 is disposed in a section between the floor 1 and the immediate roof 3; a return airway and a transportation roadway are respectively disposed on a left side and a right side of a section; a return airway and a transportation roadway in each section is communicated with each other through a working face; and non-pillar staggered layout is used for a return airway of a next section and a transportation roadway of a current section.

As shown in FIG. 1(*a*), during longwall mining of a DITCS, a first-section working face 9 is arranged in the coal seam 2, where a first-section return airway 5 is arranged along the floor 1 of the coal seam, a first-section transportation roadway 6 is arranged along the immediate roof 3; and the first-section working face 9 is connected to the first-section transportation roadway 6 by using a method for gradually reducing a mining height of an inclined lower part of the working face. During mining of a second section 10, a second-section return airway 7 and a second-section transportation roadway 8 are arranged in a same manner as the first-section return airway 5 and the first-section transportation roadway 6 of a first section. A position of the second-section return airway 7 mainly depends on factors such as thicknesses and strength of the coal seam, the roof, and the floor, and specific parameters can be determined through theoretical calculation, physical simulation, and numerical research.

The position of the second-section return airway 7 is selected according to the following principles:

(1) A coal pillar section is reduced in size as much as possible or no coal pillar section is used to implement non-pillar mining. (2) The second-section return airway 7 is arranged as possible outside or at an edge of an area in which roof stress is concentrated between sections, preventing the second-section return airway 7 from being subject to concentrated stress. (3) If objective conditions permit, upper staggered layout is used for the second-section return airway 7 as possible, so that the second-section return airway 7 is located inside a fissure zone of the coal seam, and a deformation amount of the roadway is reduced due to buffer of a fractured coal seam. In addition, the roadway can be protected by an inclined masonry structure in a first-section goaf 12, thereby ensuring the stability of the second-section return airway 7 and reducing maintenance costs.

As shown in FIG. 1(*b*), during mining of the second section, the second-section return airway 7 and the second-section transportation roadway 8 are arranged in a same manner as the first-section return airway 5 and the first-section transportation roadway 6 of the first section. A position of the second-section return airway 7 mainly depends on factors such as thicknesses and strength of the coal seam, the roof, and the floor, and specific parameters can be determined through theoretical calculation, physical simulation, and numerical research.

When conditions of the thicknesses and strength of the coal seam, the roof, and the floor permit, the position of the second-section return airway 7 can be determined based on a spacing between roadways, that is, it is ensured that a thickness of a coal seam between the roadways is greater than 2 m. Lower staggered layout is used for coal seam with a thickness of approximately 3.5-4.0 m, superposed layout is used for coal seam with a thickness of 4.0-5.5 m, and upper staggered layout is used for coal seam with a thickness greater than 5.5 m.

Figure 2A:
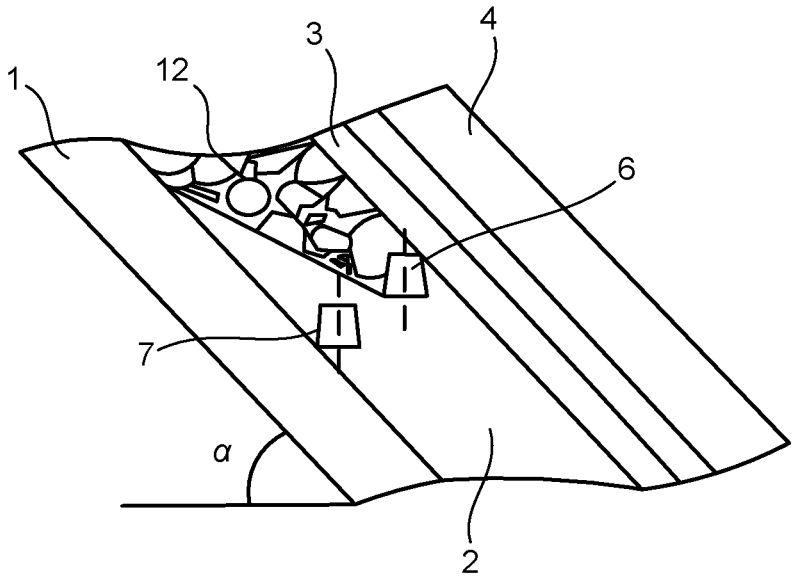
FIG. 2(*a*) to FIG. 2(*c*) are a location diagram of a staggered roadway.
Figure 2B:
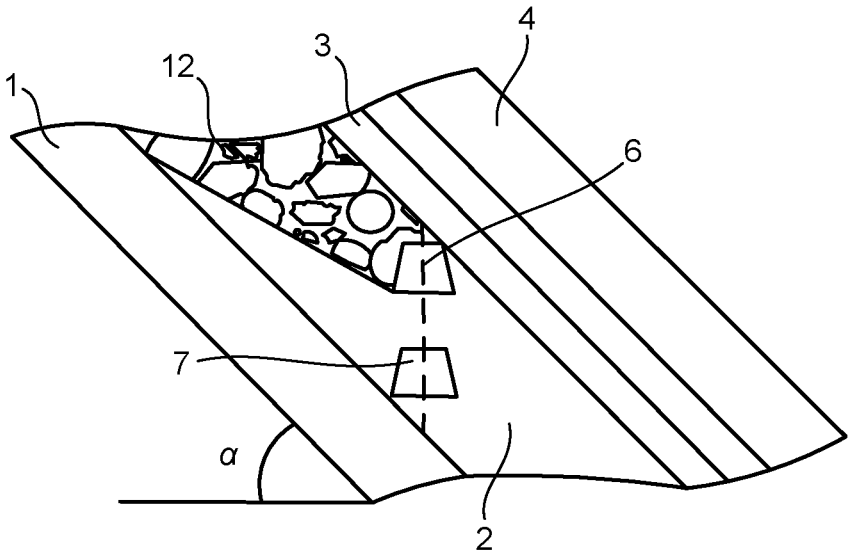
Figure 2C:
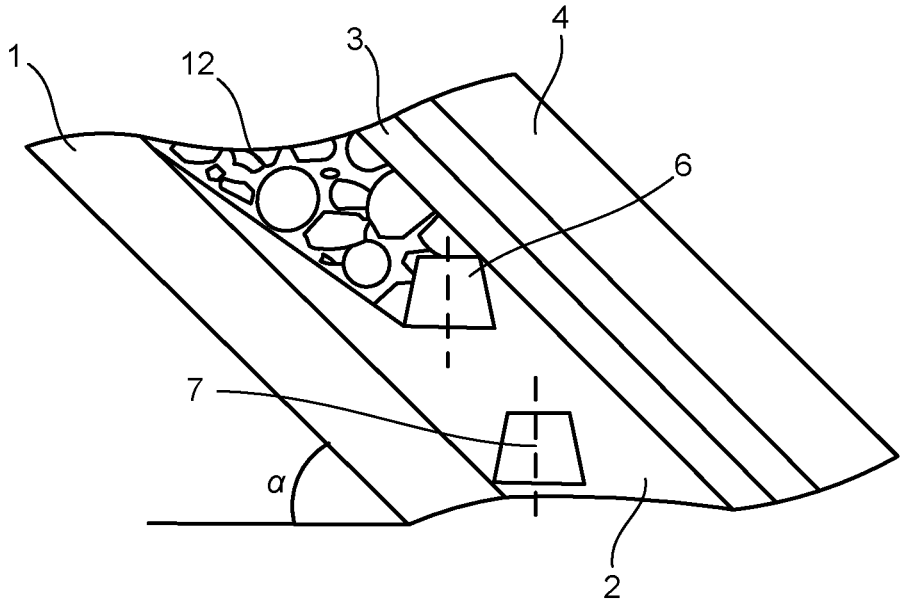

FIG. 2(*a*) to FIG. 2(*c*) show a position diagram of a staggered roadway of the first-section transportation roadway 6 and the second-section return airway 7 in the present invention. When conditions of thicknesses and strength of the coal seam 2, the immediate roof 3, and the basis roof 4 permit, a position of the second-section return airway 7 can be determined based on a spacing between roadways, that is, it is ensured that a thickness of a coal seam between the roadways (a vertical distance between the first-section transportation roadway 6 and the second-section return airway 7) is greater than 2 m. Lower staggered layout is used for coal seam with a thickness of approximately 3.5-4.0 m, as shown in FIG. 2(*c*). Superposed layout is used for coal seam with a thickness of 4.0-5.5 m, as shown in FIG. 2(B). Upper staggered layout is used for coal seam with a thickness greater than 5.5 m, as shown in FIG. 2(*a*).

FIG. 1(*c*) shows characteristics of mining of the second section and transportation and filling of gangue in a goaf in the present invention. A process of a method for coal pillar filling between sections of a multi-section non-pillar staggered protected roadway for a DITCS is as follows: During longwall mining of a DITCS, after a first-section working face is mined, coal on a side obliquely below a second-section return airway 7 is mined out as a second-section working face is mined; hydraulic supports are successively withdrawn and placed onto a working face of a next section; fractured coal 14 of a first section on a side obliquely above the roadway is immediately destructed because the roadway becomes instable, so as to form crushed coal 17; and the crushed coal is transported to above a second-section goaf 16. In addition, caving gangue in a first-section goaf 12 also moves towards the second-section goaf 16 along the passage, and the caving gangue and the crushed coal 17 are together filled obliquely above the second-section goaf 16, so that an inclined upper part, middle part, and lower part of the second-section goaf 16 are all filled with a destroyed rock strata. In this way, unbalanced filling on a roof of the second-section goaf 16 is avoided, and unbalanced load on a "support-surrounding rock" system on the second-section working face 13 is reduced or eliminated, thereby resolving a core technical problem in longwall mining of a deep inclined coal seam.

Roadway layout and mining steps for working faces of a third section, a fourth section, . . . , an Nth section are the same as those for the working face of the second section. FIG. 1(*c*) shows a non-pillar staggered layout form of a third-section return airway 15 and a second-section transportation roadway 8 of the second section.

To ensure that gangue in an upper-section goaf can be effectively transported to a lower-section goaf in time, a flexible bolt-mesh-anchor support manner is used for all mining roadways. In addition, to prevent air leakage in a return airway of a lower section in non-pillar mining, measures for preventing air leakage should be taken in the roadway. Pre-drainage measures should be taken in advance in mines rich in water and gas, to ensure the safety of a working face when an upper section and the lower section are communicated with each other.

The foregoing shows and describes a basic principle, main features, specific methods and advantages of the present invention. A person skilled in the art that should understand that, the present invention is not limited by the foregoing embodiments. The foregoing embodiments and the description in this specification only illustrate the principle of the present invention. Various changes and improvements may be made to the present invention without departing from the spirit and scope of the present invention. Such changes and improvements all fall within the claimed protection scope of the present invention. The claimed protection scope of the present invention is defined by the appended claim and its equivalents.

We claim:

1. A multi-section non-pillar staggered protected roadway system for a deep inclined thick coal seam (DITCS), the multi-section non-pillar staggered protected roadway system comprising;

a floor in a multi-section coal seam, being disposed below a coal seam;

the coal seam in the multi-section coal seam;

an immediate roof in the multi-section coal seam;

a basic roof in the multi-section coal seam, wherein the floor is disposed below the multi-section coal seam;

a hydraulic support being disposed in a space between the floor and the immediate roof; and a return airway and a transportation roadway being respectively disposed on a left side and a right side of the each section, wherein the return airway and the transportation roadway in the each section communicate with each other through a working face, wherein a non-pillar staggered layout is used for the return airway of a following section and the transportation roadway of a current section.

2. The multi-section non-pillar staggered protected roadway system for the DITCS of claim 1, wherein the non-pillar staggered layout has a thickness of greater than two meters between the return airway of the following section and the transportation roadway of the current section.

3. A method for coal pillar filling between sections of the multi-section non-pillar staggered protected roadway system for the DITCS of claim 2, comprising:

(1) during longwall mining of the DITCS, after a first-section working face is mined, mining out coal on a side obliquely below a second-section return airway along with mining of a second-section working face, successively withdrawing hydraulic supports and placing them onto a working face of a subsequent section, forming crushed coal when fractured coal of a first section on a side obliquely above the first-section transportation roadway is immediately destroyed because the first-section transportation roadway becomes instable, and transporting the crushed coal to above a second-section goaf;

(2) allowing caving gangue in a first-section goaf to move towards the second-section goaf, filling the caving gangue and the crushed coal together obliquely above the second-section goaf such that an inclined upper part, middle part, and lower part of the second-section goaf are all filled with a destroyed rock strata; and (3) conducting roadway layout, mining, and filling of working faces of a third section, a fourth section, . . . , an Nth section by using a same method as that used for the second section.

4. The method for coal pillar filling between sections of claim 3, wherein a flexible support member employing a bolt-mesh anchor is used for all mining roadways so as to ensure that the caving gangue in an upper-section goaf is effectively transported to a lower-section goaf.

5. The multi-section non-pillar staggered protected roadway system for the DITCS of claim 1, wherein when a thickness of a section of the coal seam in the current section is 3.5 meters to 4.0 meters, a lower staggered layout is used for the return airway of the following section and the transportation roadway of the current section such that the return airway of the following section is located on a lower right side of the transportation roadway of the current section.

6. A method for coal pillar filling between sections of the multi-section non-pillar staggered protected roadway system for the DITCS of claim 5, comprising:

(1) during longwall mining of the DITCS, after a first-section working face is mined, mining out coal on a side obliquely below a second-section return airway along with mining of a second-section working face, successively withdrawing hydraulic supports and placing them onto a working face of a subsequent section, forming crushed coal when fractured coal of a first section on a side obliquely above the first-section transportation roadway is immediately destroyed because the first-section transportation roadway becomes instable, and transporting the crushed coal to above a second-section goaf;

(2) allowing caving gangue in a first-section goaf to move towards the second-section goaf, filling the caving gangue and the crushed coal together obliquely above the second-section goaf such that an inclined upper part, middle part, and lower part of the second-section goaf are all filled with a destroyed rock strata; and (3) conducting roadway layout, mining, and filling of working faces of a third section, a fourth section, . . . , an Nth section by using a same method as that used for the second section.

7. The method for coal pillar filling between sections of claim 6, wherein a flexible support member employing a bolt-mesh anchor is used for all mining roadways so as to ensure that a gangue in an upper-section goaf can be effectively transported to a lower-section goaf.

8. The multi-section non-pillar staggered protected roadway system for the DITCS of claim 1, wherein when a thickness of a section of the coal seam in the current section is between 4.5 meters and 5.5 meters, a superimposed layout is used for the return airway of the following section and the transportation roadway of the current section such that the return airway of the following section is located right below the transportation roadway of the current section.

9. A method for coal pillar filling between sections of the multi-section non-pillar staggered protected roadway system for the DITCS of claim 8, comprising:

(1) during longwall mining of the DITCS, after a first-section working face is mined, mining out coal on a side obliquely below a second-section return airway along with mining of a second-section working face, successively withdrawing hydraulic supports and placing them onto a working face of a subsequent section, forming crushed coal when fractured coal of a first section on a side obliquely above the first-section transportation roadway is immediately destroyed because the first-section transportation roadway becomes instable, and transporting the crushed coal to above a second-section goal;

(2) allowing caving gangue in a first-section goaf to move towards the second-section goaf, filling the caving gangue and the crushed coal together obliquely above the second-section goaf such that an inclined upper part, middle part, and lower part of the second-section goaf are all filled with a destroyed rock strata; and (3) conducting roadway layout, mining, and filling of working faces of a third section, a fourth section, . . . , an Nth section by using a same method as that used for the second section.

10. The method for coal pillar filling between sections of claim 9, wherein a flexible support member employing a bolt-mesh anchor is used for all mining roadways so as to ensure that the caving gangue in an upper-section goaf is effectively transported to a lower-section goaf.

11. The multi-section non-pillar staggered protected roadway system for the DITCS of claim 1, wherein when a thickness of a section of the coal seam in the current section is greater than 5.5 meters, an upper staggered layout is used for the return airway of the following section and the transportation roadway of the current section such that the return airway of the following section is located on a lower left side of the transportation roadway of the current section.

12. A method for coal pillar filling between sections of the multi-section non-pillar staggered protected roadway system for the DITCS of claim 11, comprising:

(1) during longwall mining of the DITCS, after a first-section working face is mined, mining out coal on a side obliquely below a second-section return airway along with mining of a second-section working face, successively withdrawing hydraulic supports and placing them onto a working face of a subsequent section, forming crushed coal when fractured coal of a first section on a side obliquely above the first-section transportation roadway is immediately destroyed because the first-section transportation roadway becomes instable, and transporting the crushed coal to above a second-section goaf;

(2) allowing caving gangue in a first-section goaf to move towards a second-section goaf, filling the caving gangue and the crushed coal together obliquely above the second-section goaf such that an inclined upper part, middle part, and lower part of the second-section goaf are all filled with a destroyed rock strata; and (3) conducting roadway layout, mining, and filling of working faces of a third section, a fourth section, . . . , an Nth section by using a same method as that used for the second section.

13. The method for coal pillar filling between sections of claim 12, wherein a flexible support member employing a bolt-mesh anchor is used for all mining roadways so as to ensure that the caving gangue in an upper-section goaf can be effectively transported to a lower-section goaf.

14. The multi-section non-pillar staggered protected roadway system for the DITCS of claim 1, wherein a flexible support member employing a bolt-mesh anchor is used for the return airway in the each section.

15. A method for coal pillar filling between sections of the multi-section non-pillar staggered protected roadway system for the DITCS of claim 14, comprising:

(1) during longwall mining of the DITCS, after a first-section working face is mined, mining out coal on a side obliquely below a second-section return airway along with mining of a second-section working face, successively withdrawing hydraulic supports and placing them onto a working face of a subsequent section, forming crushed coal when fractured coal of a first section on a side obliquely above the first-section transportation roadway is immediately destroyed because the first-section transportation roadway becomes instable, and transporting the crushed coal to above a second-section goaf;

(2) allowing caving gangue in a first-section goaf to move towards a second-section goaf along filling the caving gangue and the crushed coal together obliquely above the second-section goaf such that an inclined upper part, middle part, and lower part of the second-section goaf are all filled with a destroyed rock strata; and (3) conducting roadway layout, mining, and filling of working faces of a third section, a fourth section, . . . , an Nth section by using a same method as that used for the second section.

16. The method for coal pillar filling between sections of claim 15, wherein a flexible support member employing a bolt-mesh anchor is used for all mining roadways so as to ensure that the caving gangue in an upper-section goaf can be effectively transported to a lower-section goaf.

17. A method for coal pillar filling between sections of the multi-section non-pillar staggered protected roadway system for the DITCS of claim 1, the method comprising (1) during longwall mining of the DITCS, after a first-section working face is mined, mining out coal on a side obliquely below a second-section return airway along with mining of a second-section working face, successively withdrawing hydraulic supports and placing them onto a working face of a subsequent section so as to form crushed coal when fractured coal of a first section on a side obliquely above the first section transportation roadway is immediately destroyed because the roadway first section transportation roadway becomes instable, and transporting the crushed coal to above a second-section goaf;

(2) allowing caving gangue in a first-section goaf to move towards a second-section goaf, filling the caving gangue and the crushed coal together obliquely above the second-section goaf such that an inclined upper part, middle part, and lower part of the second-section goaf are all filled with a destroyed rock strata;

(3) conducting roadway layout, mining, and filling of working faces of a third section, a fourth section, . . . , an Nth section by using a same method as that used for the second section.

18. The method for coal pillar filling between sections of claim 17, wherein a flexible support member employing a bolt-mesh anchor is used for all mining roadways so as to ensure that the caving gangue in an upper-section goaf is effectively transported to a lower-section goaf.

* * * * *